United States Patent [19]

Boss et al.

[11] Patent Number: 4,684,118

[45] Date of Patent: Aug. 4, 1987

[54] APPARATUS FOR TEMPORARY STORAGE OF PRINTED PRODUCTS BETWEEN SUCCESSIVE PROCESSING MACHINES OF A PRODUCTION LINE

[75] Inventors: Heinz Boss, Strengelbach; Walter Weber, Brittnau, both of Switzerland

[73] Assignee: Grapha-Holding AG, Hergiswil, Switzerland

[21] Appl. No.: 942,938

[22] Filed: Dec. 19, 1986

Related U.S. Application Data

[63] Continuation of Ser. No. 785,522, Oct. 8, 1985, abandoned.

[30] Foreign Application Priority Data

Oct. 12, 1984 [CH] Switzerland ..... 4892/84

[51] Int. Cl.[4] ..... B65H 39/00

[52] U.S. Cl. ..... 270/58; 242/59; 53/430; 53/118; 198/347; 271/184

[58] Field of Search ..... 101/219, 232; 270/52, 270/58, 60; 242/67.3, 67.4, 59; 271/3, 4, 184, 186, 225, 204, 902; 198/347, 423; 53/430, 118; 414/29

[56] References Cited

U.S. PATENT DOCUMENTS

| | | | |
|---|---|---|---|
| 3,734,264 | 5/1973 | Stumpf | 198/347 |
| 3,908,978 | 9/1975 | Stemmle | 271/3 |
| 3,936,993 | 2/1976 | Dorer | 271/902 |
| 4,438,618 | 3/1984 | Honegger | 53/118 |
| 4,494,705 | 1/1985 | Linder | 242/59 |
| 4,496,142 | 1/1985 | Iwasaki | 271/902 |
| 4,509,703 | 4/1985 | Grunder | 198/347 |
| 4,525,982 | 7/1985 | Meier | 242/59 |
| 4,528,794 | 7/1985 | Thierstein | 242/59 |
| 4,528,798 | 7/1985 | Meier | 53/430 |
| 4,550,883 | 11/1985 | Boss | 242/59 |
| 4,569,488 | 2/1986 | Baltisberger | 198/347 |
| 4,575,988 | 3/1986 | Meier | 53/430 |
| 4,582,272 | 4/1986 | Reist | 53/118 |
| 4,589,603 | 5/1986 | Muller | 53/430 |
| 4,597,243 | 7/1986 | Honegger | 53/430 |

FOREIGN PATENT DOCUMENTS

| | | | |
|---|---|---|---|
| 2061235 | 5/1981 | United Kingdom | 271/182 |
| 2119869 | 11/1983 | United Kingdom | 242/59 |

*Primary Examiner*—E. H. Eickholt

*Attorney, Agent, or Firm*—Peter K. Kontler

[57] ABSTRACT

Signatures, newspaper sections or like printed products are temporarily stored between two successive processing machines of a production line by convoluting them onto a rotor with a flexible band so that the products are stored between neighboring convolutions of the band. The products are stored when the output of the preceding machine exceeds the requirements of the next-following machine, and the rotor is caused to pay out stored products when the requirements of the next-following machine exceed the output of the preceding machine. The rotor can store printed products in the form of a stream of spaced-apart products or in the form of a scalloped stream wherein the trailing portion of each preceding product overlaps the leader of the next-following product. A stream of spaced-apart products can be converted into a scalloped stream on its way to the reservoir from a conveyor which connects the preceding machine with the next-following machine.

3 Claims, 4 Drawing Figures

APPARATUS FOR TEMPORARY STORAGE OF PRINTED PRODUCTS BETWEEN SUCCESSIVE PROCESSING MACHINES OF A PRODUCTION LINE

This application is a continuation of application Ser. No. 785,522 filed Oct. 8, 1985, abandoned.

BACKGROUND OF THE INVENTION

The present invention relates to apparatus for temporary storage of printed products, and more particularly to improvements in apparatus for temporary storage of printed products between successive processing machines of a production line. For example, the apparatus of the present invention can be utilized for temporary storage of newspaper sections, signatures or analogous printed products between a gathering machine and a packing machine.

It is customary to treat signatures, newspaper sections and similar printed products in a plurality of successive printing, trimming, gathering, folding, stacking and/or other machines which together constitute or form part of a complete production line. The assembly of two or more machines and suitable conveyors into a production line greatly enhances the output of the plant as long as all of the machines operate at their rated speeds. However, the output of the entire production line must be reduced considerably if a single machine of a series of several successive machines in the production line is arrested or is compelled to operate at less than its rated speed. As a rule, or at least in many instances, the bottleneck which is caused by the slowdown or stoppage of a single machine entails immediate stoppage of the entire production line.

OBJECTS AND SUMMARY OF THE INVENTION

An object of the invention is to provide a novel and improved apparatus which can be used in a production line for printed products to reduce the likelihood of lengthy stoppages and/or pronounced reduction of the output of the entire production line.

Another object of the invention is to provide a novel and improved reservoir for temporary storage of printed products in a production line.

A further object of the invention is to provide a production line which embodies the above outlined reservoir and wherein the reservoir can accept and temporarily store substantial quantities of printed products so as to prevent prolonged stoppages or slowdowns of the preceding and/or next-following processing machine or machines.

An additional object of the invention is to provide a novel and improved method of preventing long-lasting stoppages or slowdowns of a production line for printed products.

Still another object of the invention is to provide the production line with a novel conveyor system which can be utilized to transport printed products between successive processing machines and/or to storage.

The invention is embodied in a production line for printed products, particularly paper sheets which together constitute signatures, newspaper sections and the like. The production line comprises an apparatus which includes a first processing unit for printed products, a second processing unit for printed products, means for transporting printed products from the first to the second unit, a reservoir (preferably a first-in last-out reservoir), and means for conveying printed products between the transporting means and the reservoir so that the reservoir can take up the surplus of printed products when the output of the first unit exceeds the requirements of the second unit and that the reservoir can supply printed products to the second unit by way of the transporting means when the requirements of the second unit exceed the output of the first unit. It is also possible to establish a direct connection between the reservoir and the second unit in lieu of or in addition to the connection between the second unit and the reservoir by way of the transporting means.

In accordance with a presently preferred embodiment, the reservoir comprises first and second rotors, a flexible band having first and second end portions which are affixed to the respective rotors and an intermediate portion, and means for selectively rotating at least one of the rotors in directions to convolute the intermediate portion of the band onto and to unwind the intermediate portion from the one rotor. The conveying means of such apparatus comprises means for feeding printed products from the transporting means onto the intermediate portion of the band so that the thus supplied products are stored on the one rotor between the convolutions of the intermediate portion.

The feeding means of the conveying means can constitute a reversible feeding unit which serves to advance printed products from the reservoir to the transporting means and vice versa, and a switchover device having means for selectively diverting products from the transporting means to the feeding unit.

The first unit can be designed to discharge a file of discrete printed products (namely printed products which do not overlap each other), and the conveying means can include means for converting such file of discrete products into a stream of partially overlapping printed products so that the reservoir receives and stores products of the thus obtained imbricated or scalloped stream. The converting means is preferably designed to overlap the leader of each next-following product by the trailing end of the respective preceding product.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 4:
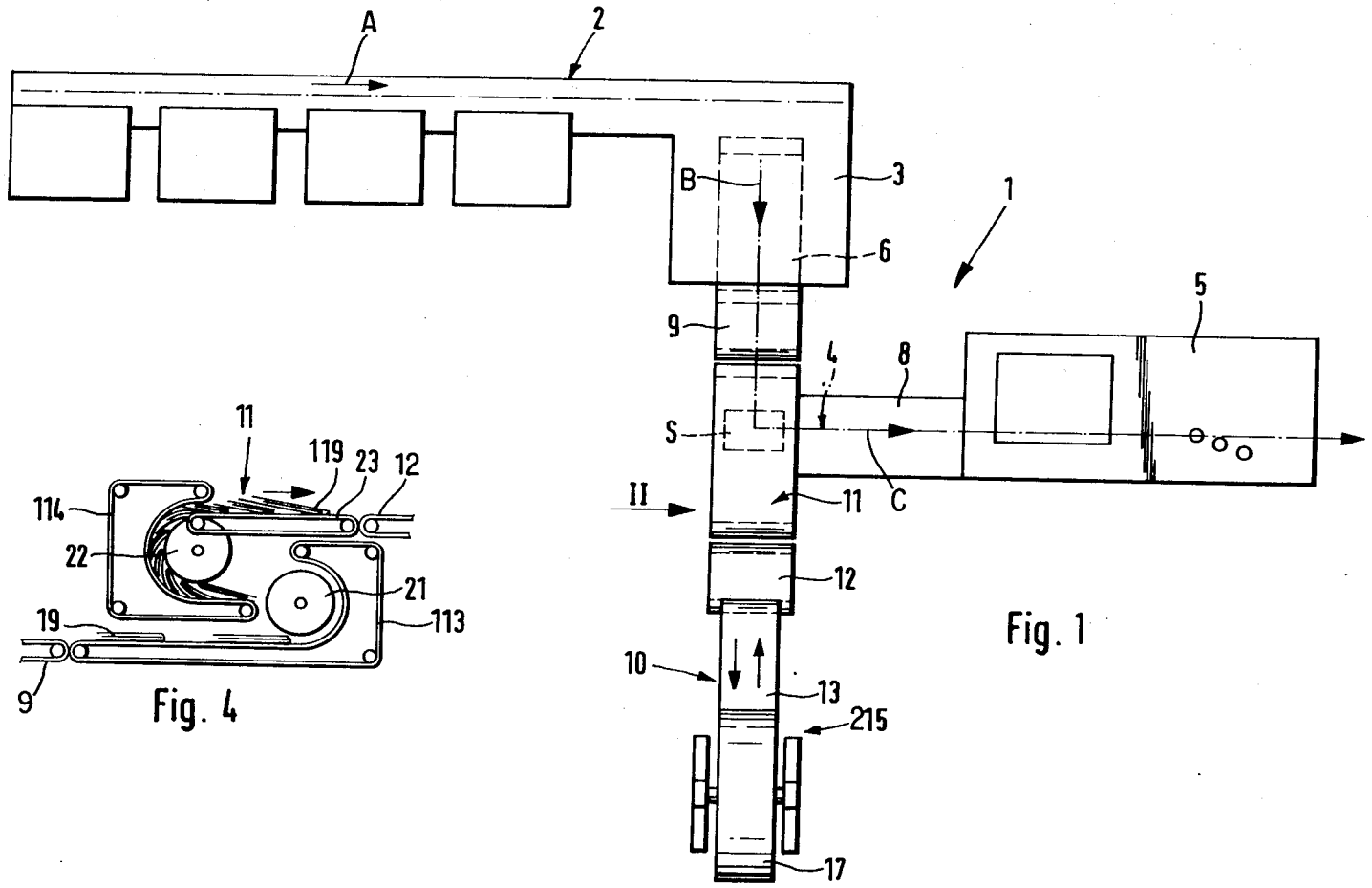
FIG. 1 is a schematic plan view of a production line which embodies one form of the improved apparatus for temporary storage of printed products between two successive processing machines.
FIG. 4 is a fragmentary schematic elevational view of a third apparatus with modified means for converting a file of discrete printed products into a stream of partially overlapping products.
Figure 2:
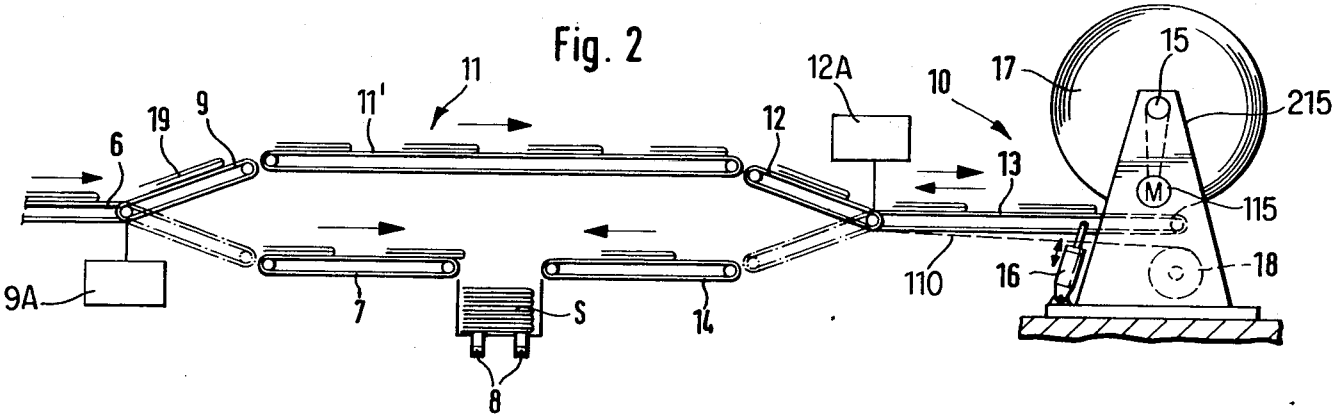
FIG. 2 is an elevational view as seen in the direction of arrow II in FIG. 1.

Referring first to FIGS. 1 and 2, there is shown a production line 1 having a first processing unit in the form of a gathering machine 2, a second processing unit 5 which constitutes a packing machine, and transporting means 4 serving to advance printed products 19 from the first unit 2 toward and into the second unit 5. The transporting means 4 comprises several discrete conveyors or sections including a first section 6, a second section 7 and a third section 8. Each of these sections comprises one or more endless belts or chains the exact design of which forms no part of the invention.

The first unit 2 has a lateral outlet 3 so that it discharges a stream of discrete printed products 19 in the direction of the arrow B shown in FIG. 1. The direction of transport of successive printed products 19 through the major part of the first unit 2 is indicated by the arrow A. The units 2 and 5 are commercially available machines the exact construction of which forms no part of the present invention.

In addition to the aforementioned sections 6, 7 and 8, the transporting means 4 further comprises a pivotable section 9 which constitutes a switchover device serving to selectively divert printed products 19 from the transporting means 4 onto a conveying means 11 designed to deliver such products to a buffer or reservoir 10 which is of the first-in last-out type, as well as from the reservoir 10 to the section 8 of the transporting means 4. The means for pivoting the section or switchover device 9 between the solid-line and phantom-line positions of FIG. 2 is shown at 9A. Such pivoting means can comprise an electromagnet, a rack-and-pinion drive or any other suitable means which can shift the endless belt(s) or chain(s) of the device 9 between the solid-line and phantom-line positions of FIG. 2. When the device 9 is held in the phantom-line position of FIG. 2, the production line 1 including the processing units 2 and 5 operates normally, namely the output of the unit 2 is transported from the outlet 3 toward and into the unit 5 by way of the sections 6, 9, 7 and 8. It will be noted that the section 8 changes the direction of transport of printed products 19 from that which is indicated by the arrow B to that which is indicated by the arrow C.

The illustrated reservoir 10 comprises a first rotor 15 which is mounted in a frame or housing 215, a second rotor 18 which is also mounted in the housing 215, and an endless flexible elastic band 110 one end portion of which is affixed to the rotor 15, the other end portion of which is affixed to the rotor 18, and the intermediate portion of which can be convoluted onto the rotor 15 or onto the rotor 18. As shown in FIG. 2, the intermediate portion of the band 110 is trained over one pulley of a belt or chain conveyor on a pivotable lever 13 which is biased toward the periphery of the rotor 15 by a pneumatically or hydraulically operated cylinder and piston unit 16. The rotor 15 can be selectively driven in a counterclockwise or in a clockwise direction by a reversible electric motor 115 which is mounted in the housing 215. A separate motor (not specifically shown) is provided to rotate the rotor 18, at least in a direction to convolute the intermediate portion of the band 110 therearound. The rotors 15 and 18 are preferably rotatable about substantially horizontal axes.

The conveying means 11 comprises a first section 11' which can receive printed products 19 from the switchover device 9, a second section 12 (reversible feeding unit) which is movable between the solid-line and phantom-line positions of FIG. 2 by pivoting means 12A, and a third section 14 which can be driven to advance printed products 19 from the section 12 to the section 8 of the transporting means 4. The conveyor or conveyors on the pivotable lever 13 also form part of the conveying means 11. The pivotable switchover device 9 can be said to form part of the conveying means 11 or of the transporting means 4.

In the embodiment of FIGS. 1 and 2, the sections 6, 9 and 7 of the transporting means 4 are continuously driven when the processing unit 2 is operative to turn out printed products 19 which are to be transported to the processing unit 5. On the other hand, the conveyors of the section 8 are operated intermittently so that they accumulate a stack S of overlapping printed products 19 before they advance the stack immediately into the unit 5 or to one or more intermediate stations between the discharge end of the section 7 and the inlet of the unit 5.

The operation of the apparatus which is shown in FIGS. 1 and 2 is as follows:

If the switchover device 9 and the section 12 of the conveying means 11 are held in the solid-line positions of FIG. 2, the transporting means 4 delivers successive printed products 19 to the conveying means 11 which delivers such products into storage, namely into the reservoir 10. As shown in FIG. 2, the sections 6, 9 and 11' deliver a single file of discrete (non-overlapping) printed products 19 onto the upper reach or reaches of the conveyor or conveyors forming part of the pivotable section 12, and such products are thereupon transferred onto the conveyor or conveyors which are carried by the pivotable lever 13. The products come to rest on the intermediate portion of the band 110 which advances in a direction to the right, as viewed in FIG. 2, so that it transports a stream of discrete printed products 19 onto the rotor 15 whereon such products are stored between successive convolutions of the intermediate portion of the band 110. FIG. 2 shows that the reservoir 10 already contains a substantial supply 17 of convoluted band 110 and discrete printed products 19 between the convolutions of such band. The just described mode of operation will be selected when the output of the first unit 2 exceeds the requirements of the second unit 5, for example, when the unit 5 is brought to a complete halt while the unit 2 continues to turn out printed products at a maximum rate or even at a lower rate.

If the unit 5 is restarted so that it can accept the entire output of the unit 2, the pivoting means 9A is operated to move the switchover device 9 to the phantom-line position of FIG. 2 so that the products 19 are advanced from the section 6 onto the section 7 of the transporting means 4 and thence onto the upper reaches of conveyors forming part of the section 8 whereon the printed products 19 gather into a succession of stacks S which are advanced into the unit 5. If desired or necessary, the section 12 can be pivoted to the phantom-line position of FIG. 2 simultaneously with pivoting of the switchover device 9 so that the section 8 of the transporting means 4 can receive printed products 19 from the section 7 as well as from the section 14. For example, the unit 2 may be operated at half the normal speed while the unit 5 is operated at a maximum speed. The requirements of the unit 5 are then partially met by the unit 2 and in part by the reservoir 10. It is clear that the movements of conveyors in the sections 7 and 14 must be synchronized so that the products which are delivered by the conveyor or conveyors of the section 7 do not clash with the products which are delivered by the conveyor or conveyors of the section 14.

Of course, the reservoir 10 can be used to deliver printed products 19 to the conveyors of the section 8 without any delivery of printed products from the unit 2. Such situation will develop if the unit 2 is defective or is arrested for other reasons.

The reversible motors for the conveyor or conveyors of each of the sections 12 and 14 and for the conveyor or conveyors on the pivotable lever 13 are not specifically shown in the drawings. Reference may be had to numerous pending applications and granted United States Letters Patent of the assignee of the present application wherein the reservoir 10 and similar reservoirs are described in full detail.

Figure 3:
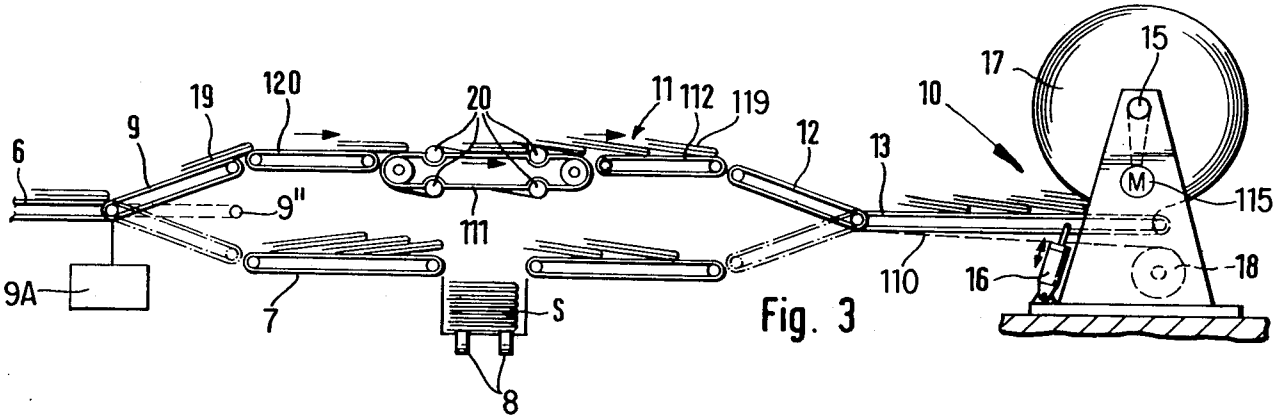
FIG. 3 is a schematic elevational view of a second apparatus which includes means for converting a file of discrete printed products into a stream of partially overlapping products.

FIG. 3 shows a portion of a modified apparatus. The reservoir 10 is identical with the reservoir of FIGS. 1 and 2. The main difference between the apparatus of FIGS. 2 and 3 is that the conveying means 11 of the apparatus which is shown in FIG. 3 is designed to convert a stream of discrete (non-overlapping) printed products 19 coming from the section 6 of the transporting means 4 into a so-called scalloped or imbricated stream 119 of partially overlapping printed products wherein the trailing portion of each preceding product overlaps the leading end of the next-following product.

The conveying means 11 of FIG. 3 comprises a first section 120, a second section 111 which constitutes a component of the means for converting a single file of non-overlapping printed products 19 into a scalloped stream 119 of partially overlapping products, and a third section 112 which receives successive increments of the stream 119 from the section 111. The construction and mode of operation of the pivotable sections 9 and 12 are identical with the construction and mode of operation of similarly referenced sections in the apparatus of FIG. 2. The conveyor of the section 111 of conveying means 11 shown in FIG. 3 comprises a plurality of wedge-like projections 20 whose pointed portions face forwardly, as considered in the direction of movement of the upper reach of the conveyor forming part of the section 111. The trailing portions of the wedge-like projections 20 extend above the upper reach of the conveyor of the section 111, and the speed of such conveyor is less than the speed of the conveyor forming part of the section 120. The extent to which the trailing portion of each projection 20 extends upwardly and beyond the upper reach of the conveyor forming part of the section 111 at least equals the thickness of a printed product 19. The section 120 delivers a printed product 19 during each cycle of the processing unit 2 which supplies products to the transporting means 4 including the section 6 of FIG. 3. The product 19 which is delivered by the section 120 comes to rest on the upper reach of the conveyor forming part of the section 111 between two successive projections 20. The speed ratio of the conveyors in sections 120 and 111 is selected in such a way that the leader of a next-following product 19 comes to rest immediately behind the enlarged rear portion of a projection 20 while such rear portion maintains the trailing end of the preceding printed product 19 in raised position. When the just discussed products 19 advance beyond the upper reach of the conveyor of the section 111, the trailing portion of the preceding product 19 overlaps the leader of the next-following product 19. This can be readily seen by looking at the upper reach or reaches of the conveyor or conveyors forming part of the section 112 which is shown in FIG. 3. Actually, each wedge-shaped projection 20 raises the trailing portion of the printed product 19 which is disposed thereabove so that the trailing portion is lifted above the upper reach of the conveyor of the section 111 and can overlap the leader of the product 19 which is delivered by the section 120. The section 112 delivers the stream 119 onto the conveyor or conveyors of the section 12 which, in turn, delivers such stream onto the upper reach or reaches of the conveyor or conveyors on the lever 13 so that the supply 17 on the rotor 15 of FIG. 3 contains a convoluted scalloped stream 119 between the convolutions of the intermediate portion of the flexible elastic band 110.

If it is desired to convert the stream of discrete printed products 19 into a scalloped stream 119 while the products advance from the section 6 toward and onto the section 8 of the transporting means 4 which is shown in FIG. 3, the pivoting means 9A is actuated to move the section or switchover device 9 to the intermediate position 9'' of FIG. 3 so that the discharge end or ends of the conveyor or conveyors forming part of the section 9 are located at a level above the upper reach or reaches of the conveyor or conveyors forming part of the section 7. Furthermore, the section 7 is then connected or associated with a drive which causes the corresponding conveyor or conveyors to transport printed products 19 at a speed which is less than that of the conveyor or conveyors forming part of the section or switchover device 9. Consequently, the stream of discrete printed products 19 on the section 6 is converted into a scalloped stream 119 the constituents of which are delivered onto the upper reaches of the conveyors forming part of the section 8 so that such products form a stack S. The reservoir 10 of FIG. 3 is designed to deliver the scalloped stream 119 from the supply 17 onto the conveyors of the section 8 when the need arises, i.e., when the requirements of the second unit 5 exceed the output of the first unit 2. As mentioned above, the conveyors of the section 8 are preferably operated intermittently so that they automatically accumulate a succession of stacks S for intermittent transport into the second unit 5.

FIG. 4 shows a portion of modified conveying means 11 which can be utilized in lieu of the conveying means of FIG. 3. Such conveying means is also designed to convert a stream of non-overlapping printed products 9 (delivered by the switchover device or section 9) into a scalloped stream 119 successive increments of which are transferred onto the section 12 for admission into the reservoir 10 (not shown in FIG. 4). The conveying means 11 of FIG. 4 comprises a first endless inverting belt 113 which is driven at a relatively high speed and receives the stream of discrete (non-overlapping) printed products 19 from the switchover device 9 when the latter is caused to interrupt the delivery of printed products from the section 6 to the section 7 of the transporting means. The inverting belt 113 cooperates with a drum 21 so as to change the direction of transport of successive printed products 19 and to deposit such products on the adjacent portion of a relatively slow second endless inverting belt 114 travelling around a second drum 22. The channel between the drum 22 and belt 114 accumulates a scalloped stream 119 which is thereupon delivered onto the upper reach or reaches of the conveyor or conveyors forming part of the section 12 for admission into the reservoir. FIG. 4 further shows an intermediate belt or chain conveyor 23 which is interposed between the discharge end of the relatively slow inverting belt 114 and the conveyor or conveyors of the section 12.

If the production line including the processing units 2 and 5 comprises one or more additional machines, such production line can comprise one or more additional reservoirs which can be installed downstream of the unit 5 or upstream of the unit 2. Furthermore, if the capacity of the selected reservoir or reservoirs is limited, the production line can comprise two or more reservoirs 10 between the units 2 and 5. The construction of the conveyor means 11 is then modified so that it can switch from the delivery of printed products 19 to a first reservoir 10 to the delivery of products to a second reservoir, or to a further reservoir, as soon as the previously supplied reservoir is filled to capacity.

An important advantage of the improved apparatus is that it eliminates the need for a considerable reduction of the output of the production line just because a processing unit is out of commission or operates at less than normal speed. Furthermore, it is possible to supply a next-following processing unit with printed products while the preceding unit is arrested on purpose, for example, for the purposes of inspection and/or repair. Still further, the reservoir can satisfy the requirements of the next following unit while the preceding unit or units of the production line are in the process of being converted for the making and/or processing of a different line of products.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a production line for printed products, particularly paper sheets, the combination of a first processing unit for printed products; a second processing unit for printed products; means for transporting printed products from said first unit to and beyond said second unit, said transporting means including a segment which extends between said first and second units; a reservoir for temporary storage of printed products travelling from said first unit to said second unit by way of said segment, said reservoir comprising first and second rotors, a flexible band having first and second end portions affixed to the respective rotors and an intermediate portion, and means for selectively rotating at least one of said rotors in directions to convolute the intermediate portion of the band onto and to unwind the intermediate portion from said one rotor; and means for conveying printed products from said segment to said reservoir and back so that the reservoir can take up the surplus of printed products when the output of the first unit exceeds the requirements of the second unit and the reservoir can supply printed products to the second unit by way of said segment when the requirements of the second unit exceed the output of the first unit, said conveying means comprising means for feeding printed products from said segment onto the intermediate portion of said band so that the products thus fed are stored on the one rotor between the convolutions of said intermediate portion.

2. The combination of claim 1, wherein said reservoir is a first-in last-out reservoir.

3. The combination of claim 1, wherein said feeding means comprises a reversible feeding unit, said conveying means comprising a switchover device for selectively diverting products from said segment to said feeding unit.

* * * * *